United States Patent [19]

Hughes

[11] Patent Number: 4,513,184

[45] Date of Patent: Apr. 23, 1985

[54] FLOW ACTUATED SWITCH

[76] Inventor: Richard E. Hughes, 821 Loma Dr., Hermosa Beach, Calif. 90254

[21] Appl. No.: 532,693

[22] Filed: Sep. 16, 1983

[51] Int. Cl.[3] ..... H01H 35/40

[52] U.S. Cl. ..... 200/81.9 M; 73/319; 200/84 C

[58] Field of Search ..... 200/61.83, 81 R, 81.4, 200/81.9 R, 81.9 M, 82 E, 84 R, 84 C; 73/305, 319; 340/624

[56] References Cited

U.S. PATENT DOCUMENTS

| | | | |
|---|---|---|---|
| 1,889,705 | 11/1932 | Sherwood | 73/319 X |
| 2,233,235 | 2/1941 | Witthaus | 73/319 |
| 3,549,839 | 12/1970 | Hill et al. | 200/81.9 M |
| 3,555,221 | 1/1971 | Booth | 200/84 C |
| 3,751,614 | 8/1973 | Jones | 200/84 C |
| 3,851,127 | 11/1974 | Gardner, Jr. et al. | 200/84 C X |
| 3,942,526 | 3/1976 | Wilder et al. | 200/84 C X |
| 4,213,021 | 7/1980 | Alexander | 200/81.9 M |

*Primary Examiner*—J. R. Scott

*Attorney, Agent, or Firm*—Cislo, O'Reilly & Thomas

[57] ABSTRACT

A fluid flow indicator including a magnetic switch mounted adjacent a fluid carrying conduit. A magnetic plunger is loosely contained by the conduit and is urged to the proximity of the switch by fluid flow through the conduit thereby activating the switch. The magnetic plunger is restricted to movement within the monitoring conduit by rods transverse to the fluid flow, one located at the inlet and the other located at the outlet of the monitoring conduit, and having their termini operatively received and retained in annular channels formed in the walls of the monitoring conduit. A process for fabricating a fluid flow indicator as claimed herein is also taught.

8 Claims, 3 Drawing Figures

FLOW ACTUATED SWITCH

FIELD OF THE INVENTION

This invention relates to a flow actuated indicator, and more particularly to a flow actuated indicator which is responsive to monitor a flow and provide a magnetic switch arrangement particularly suitable for actuating a device in an electrical or electronic circuit such as biomedical instruments, pollution control monitors, analyzers and the like.

This invention also relates to a method of fabricating a flow actuated indicator as described hereinbelow.

DESCRIPTION OF THE PRIOR ART

While the prior art has recognized the need for flow actuated indicators and monitoring devices, none have disclosed the unique design of the herein disclosed inventive device.

Likewise, the method of fabricating the inventive device taught herein, is itself a unique process not disclosed in the prior art for fabricating such flow actuated indicators and monitoring devices.

Warnock, U.S. Pat. No. 3,507,359, is directed to a lubricating system having a magnetic reed switch actuated by the position of a permanent magnet moving within a cylinder. However, this is not a flow-through situation as taught herein, as the inlet end is positioned normal to the outlet end, in direct contradistinction to the straight monitoring flow passage required in the invention herein.

Hoffman, U.S. Pat. No. 3,429,291, teaches a differentialpressure, responsive indicating system having a permanent magnet switch. Fluid is brought into the system through a fitting. The diameter of the magnet, however, appears to be substantially equal to the bore, thereby preventing any flow through the system from the inlet to the outlet as the present invention calls for in order to successfully operate.

Hill and Noorda, U.S. Pat. No. 3,549,839, is directed to a fluid flow monitor having a magnet movable within a vertical bore for activation of a reed switch. Fluid passes internal to the system through a pipe and is diverted normal to its original flow to enter the monitoring conduit. At the outlet of the monitoring conduit, the fluid is once again diverted normal its monitoring conduit flow into an external exit pipe. The present invention utilizes a straight monitoring flow passage thereby providing increased sensitivity and accuracy to monitor changes in flow by smoothing out perturbations caused by redirecting the internal fluid flow as is required in the Hill and Noorda Patent referenced herein.

Breed, U.S. Pat. No. 3,510,607, is directed to an impulse actuated reed switch. The impulse to actuate the reed switch is provided by a linearly directed magnet/-piston assembly mounted within a bore. This device requires an impact from pyrotechnics, acceleration or pressurized forces to actuate the reed switch. Consequently, small, gradual changes in the monitored flow may fail to produce the impulse necessary to operate this device until they accumulate a sufficient impact to linearly displace the magnet/piston assembly thereby actuating the reed switch. The herein described invention is constructed to operate in a more sensitive manner by using a magnetically actuated reed switch and flow monitoring plunger, unlike that shown in the Breed Patent referenced herein to detect and respond to small, gradual, as well as impact-like changes, that may occur in the flow being monitored.

Patterson, U.S. Pat. No. 2,963,563, is a flow actuated signalling device and includes a magnet which has a reduced diameter relative to the bore of the monitoring flow passage. This reduced diameter allows for a passage around the magnet whose flow area is sufficient to afford flow to the portions of the bore which are adjacent to a plug in the bore. The fluid being monitored passes through an opening in the plug and continues to the outlet portion of the bore. The movement of the magnet actuates a switch. This reference clearly differs from the invention taught herein in that the means used to retain the magnet within the bore of the monitoring flow passage is entirely different. The reference uses plug members having bores throughout to retain the longitudinal positioning of the magnet within the monitoring flow passage. The invention taught herein uses a first and a second annular channel positioned adjacent the inlet and outlet of the monitoring flow passage to receive and retain therein the termini of a first and a second rod member respectively. The restraining means taught herein provide for a more sensitive and accurate response to changes in the flow of the monitored fluid by not varying the diameter of the monitoring flow passage as taught by the Patterson referenced Patent.

OBJECTIVES AND SUMMARY OF THE INVENTION

It is an object of the invention to provide a flow actuated indicator which is responsive to monitor a flow.

It is another object of the invention to provide a flow actuated indicator which provides a magnetic switch arrangement particularly suitable for actuating a device in an electrical or electronic circuit, such as, biomedical instruments, pollution control monitors, analyzers and the like.

It is another important object of the invention to provide a flow actuated indicator which is of a simple and economical construction and is formed from a body defining a straight, monitoring flow passage therethrough with an inlet in one end and an outlet at the other end. A magnetic plunger is loosely contained by said monitoring flow passage such that when the monitor is oriented with said inlet below said outlet and fluid flows from said inlet to said outlet through said monitoring flow passage, resistance to longitudinal movement of the plunger through the monitoring flow passage by said fluid is provided solely by the weight of said plunger, whereby the absence of fluid flow through said monitoring flow passage, said plunger rests near the inlet under the influence of gravity, but when fluid flows through said monitoring flow passage the plunger is carried by the fluid for a distance, depending on the velocity of the fluid, longitudinally in said monitoring flow passage away from said inlet. A restraining means is taught to restrict the plunger to longitudinal movement within the monitoring flow passage. A switch means, operatively responsive to magnetic attractions, adapted for connection into an external electrical or electronic circuit, is mounted in the proximity of the monitoring flow passage at a region such that it is operated by magnetic interaction with the plunger when the plunger is urged a predetermined distance from the inlet.

It is another still, even more important object of the invention, to provide a flow actuated indicator formed as suggested immediately above wherein said restraining means comprises a first and a second annular channel normal to the fluid flow and positioned adjacent the inlet and outlet of the monitoring flow passage on the internal wall of said bore. A first and a second rod member is operatively retained within said first and second annular channels to restrain said plunger within the straight monitoring flow passage portions of said bore.

In an exemplary embodiment, the invention is directed to a flow actuated indicator having a body defining a straight, monitoring flow passage therethrough with an inlet at one end and an outlet at another end. A magnetic plunger is loosely contained by said monitoring flow passage such that when the monitor is oriented with said inlet below said outlet and fluid flows from said inlet to said outlet through said monitoring flow passage, resistance to longitudinal movement of the plunger through the monitoring flow passage by said fluid is provided solely by the weight of said plunger, whereby, in the absence of fluid flow through said monitoring flow passage, said plunger rests near the inlet under the influence of gravity, but when fluid flows through said monitoring flow passage, the plunger is carried by the fluid for a distance depending on the velocity of the fluid longitudinally in said monitoring flow passage away from said inlet. A first and a second annular channel, normal to the fluid flow and positioned adjacent the inlet and the outlet of the monitoring flow passage on the interior wall of the bore is provided. A first and a second rod member, the termini of which are operatively retained within said first and second annular channels respectively, are used to abut the plunger member at the extremes of said monitoring flow passage. Finally, a reed switch having contact points which close in response to the plunger when it is urged a predetermined longitudinal distance within the monitoring flow passage is also provided.

It is another object of the invention to provide a method of fabricating a flow actuated indicator which comprises the steps of:

a. Constructing a body defining a straight, monitoring flow passage therethrough with an inlet at one end and an outlet at another end and having a first and a second annular channel in the walls of said monitoring flow passage, said first annular channel positioned adjacent the inlet and said second annular channel positioned adjacent the outlet of said monitoring flow passage;

b. Inserting a magnetic plunger having a cross-sectional area less than that of said monitoring flow passage into said monitoring flow passage so that said magnetic plunger is loosely contained by said monitoring flow passage such that when the monitor is oriented with said inlet below said outlet and fluid flows from said inlet to said outlet through said monitoring flow passage, resistance to longitudinal movement of the plunger through the monitoring flow passage by said fluid is provided solely by the weight of said plunger, whereby in the absence of fluid flow through said monitoring flow passage said plunger rests near the inlet under the influence of gravity but when fluid flows through said monitoring flow passage the plunger is carried by the fluid for a distance depending on the velocity of the fluid longitudinally in said monitoring flow passage away from said inlet;

c. Compressing a first and a second rod member made of a flexible, resilient material and having a longitudinal length larger than that of the diameter of said monitoring flow passage and at most equal to the diameter of said first and second annular channels, so that the longitudinal projective length of said rods is at most equal to the diameter of said monitoring flow passage;

d. Inserting said compressed first rod and said second rod into said first and second annular channels respectively, said respective channels having a cross-section of such size as to receive and retain said respective rods therein;

e. Releasing said first and second rods from their compressed state so that their termini are operatively received and retained in said annular channels;

f. Mounting a switch means operatively responsive to magnetic attraction, adapted for connection into an external electric circuit in the proximity of the monitoring flow passage at a region such that it is operated by magnetic interaction with the magnetic plunger when the magnetic plunger is urged a predetermined distance from the inlet.

These and other objects of the invention will become more apparent from the hereinafter following commentary taken in conjunction with the Figures of drawings.

BRIEF DESCRIPTION OF THE DRAWINGS

In the drawings, which illustrate what is presently regarded as the best mode for carrying out the invention.

DESCRIPTION OF THE BEST EMBODIMENTS CONTEMPLATED

Figure 1:
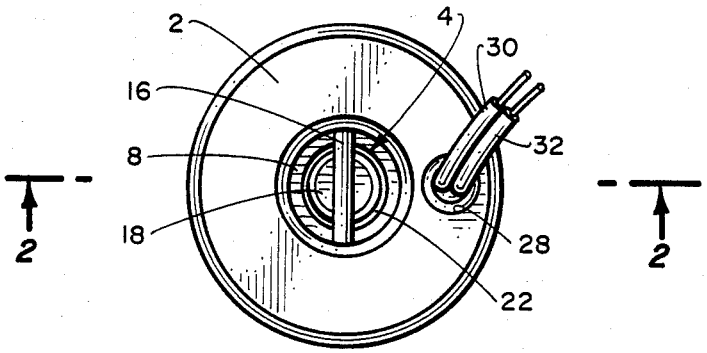
FIG. 1 is a top plan view of a fluid flow indicator.

Referring to the Figures of drawings wherein like numerals of reference designate like elements throughout, a flow actuated indicator is shown having a body member 2 which defines therethrough an axial bore 4 having an inlet end 6 and an outlet end 8.

A first annular channel 10 is recessed into said axial bore adjacent the inlet end. A second annular channel 12 is recessed into said axial bore adjacent the outlet end. Said first and second annular channels define the limits of the straight, monitoring flow passage portion 20 of said axial bore.

A first rod member 14 and a second rod member 16 are operatively received and retained in said first and second annular channels respectively. In the preferred embodiment, said rod members will be formed of a flexible, resilient material which is refactory to the fluid being monitored within said axial bore.

In order to afford a signal indication of fluid flow in the indicator, a plunger 18 is slidably received in the bore having a diameter which is less than the diameter of the straight, monitoring flow passage portion 20 of the bore by a predetermined extent, thereby defining a channel 22 between the walls of the monitoring flow passage and the plunger in order to allow a flow through of said fluid being monitored, so that when the indicator is oriented with said inlet end below said outlet end and fluid flows from said inlet end to said outlet end through said straight, monitoring flow passage portion of the axial bore, resistance to longitudinal movement of the plunger through the monitoring flow passage by said fluid is provided solely by the weight of said plunger, whereby in the absence of fluid flow through said monitoring flow passage, said plunger rests near the inlet end under the influence of gravity, but when fluid flows through said monitoring flow passage, the plunger is carried by the fluid for a distance depending on the velocity of the fluid longitudinally in said monitoring flow passage away from said inlet end and toward said outlet end.

Said plunger is retained within said monitoring flow passage by abutting rod members 14 and 16.

Figure 2:
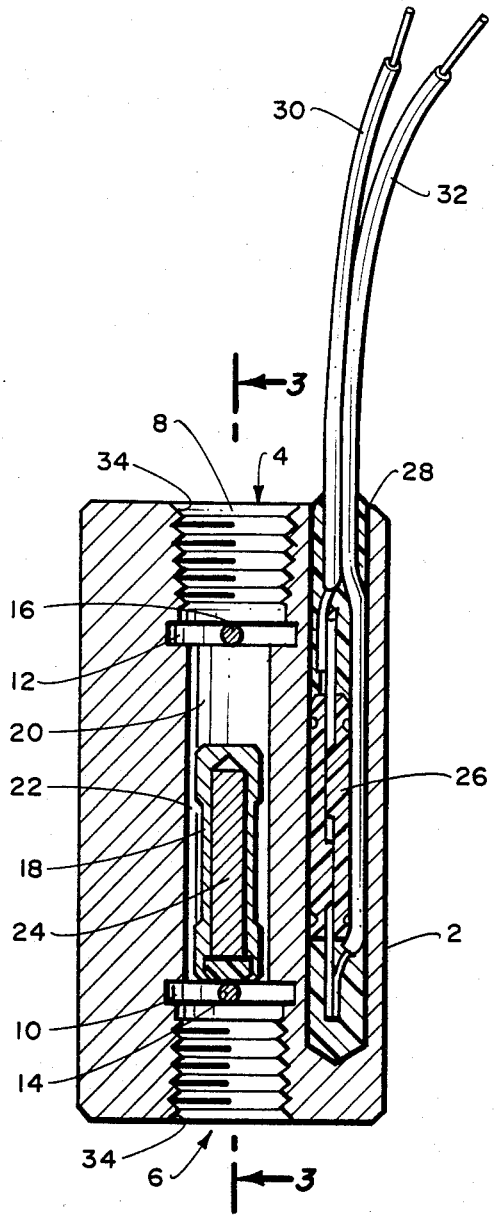
FIG. 2 is a longitudinal, cross-sectional view of the fluid indicator taken along the line 2—2 of FIG. 1.
Figure 3:
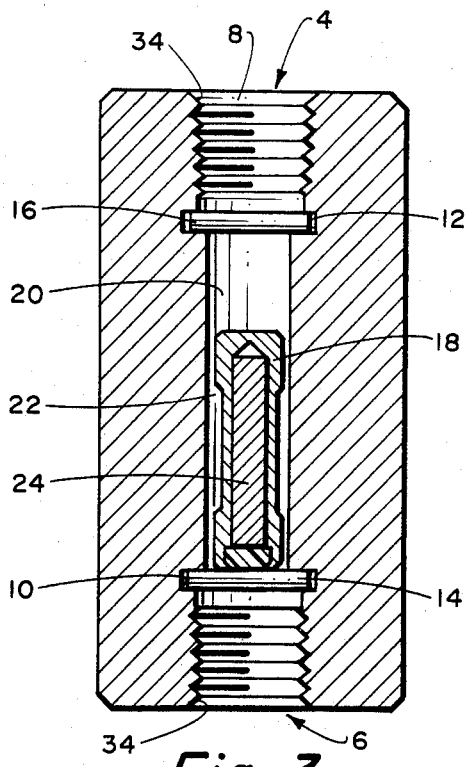
FIG. 3 is a longitudinal, cross-sectional view of a fluid flow indicator taken along the line 3—3 of FIG. 2.

As shown in FIGS. 2 and 3, said plunger contains a magnet 24. The axial movement of the magnet in response to movement of the plunger due to fluid flow through the monitoring flow passage is effective to actuate an electrical component 26 suitably mounted within a second bore 28 formed in preferably parallel relationship to the bore 4 extending from the outlet end of the body member 2 to a point adjacent the inlet end of the bore 4 in accordance with the understanding of those skilled in the art.

This electrical component may be of any suitable type which is responsive to the axial movement of the magnet effected during movement of the plunger. The indicator is calibrated in accordance with the characteristics of the component 26.

In one embodiment of the invention, the component 26 comprises a hermetically sealed, magnetically actuated switch positioned in bore 28. The leads 30 and 32 for the switch extend through the open end of the bore 28 into connection with a suitable electrical or electronic circuit for energizing a suitable signal device as hereinbefore suggested. Other suitable components, however, may be utilized within the scope of the invention as will be readily understood by those skilled in the art.

In the preferred embodiment shown in FIGS. 2 and 3, female threads 34 are shown in the walls of the axial bore 4 adjacent said inlet and outlet ends as a preferred means to connect said flow indicator to the flow source which is desired to be monitored.

Thus, there has been provided a flow indicator wherein the operation of a plunger is accurately calibrated to respond to a flow passing through the flow indicator. The fact that the plunger is dimensioned so that its external diameter is less, to a desired extent, than the diameter of the bore in which it is slidably received reduces friction in the system and maintains a quick and sensitive response in the indicator to the changes in the flows being monitored.

A preferred method of fabricating the flow actuated indicator comprises the steps of:

a. Fabricating by the known methods of casting, machining or molding, depending on the material comprising the workpiece, a body which defines a straight, monitoring flow passage therethrough with an inlet at one end and an outlet at another end and having a first and a second annular channel in the walls of said monitoring flow passage. Said first annular channel is positioned adjacent the inlet end. Said second annular channel is positioned adjacent the outlet end of said monitoring flow passage.

b. A magnetic plunger, having a cross-sectional area less than that of said monitoring flow passage is inserted into said monitoring flow passage so that said magnetic plunger is loosely contained by said monitoring flow passage that when the monitor is oriented with said inlet below said outlet and fluid flows from said inlet to said outlet through said monitoring flow passage, resistance to longitudinal movement of the plunger through the monitoring flow passage by said fluid is provided solely by the weight of said plunger. Consequently, in the absence of fluid flow through said monitoring flow passage, said plunger rests near the inlet under the influence of gravity, but when fluid flows through said monitoring flow passage, the plunger is carried by the fluid for a distance depending on the velocity of the fluid longitudinally in said monitoring flow passage and away from said inlet.

c. A first and a second rod member made of flexible, resilient material and having a longitudinal length larger than that of the diameter of said monitoring flow passage and at most equal to the diameter of said first and second annular channels respectively, are compressed so that the longitudinal projected length of said rods is at most equal to the diameter of said monitoring flow passage.

d. Said compressed first rod and second rod are now inserted into said first and said second annular channels respectively. Said respective annular channels each have a cross-section of such size as to receive and retain said respective first and second rods therein.

e. Said first and second rods are released from their compressed state so that in their expanded natural state their termini are operatively received and retained in said respective annular channels.

f. A switch means operatively responsive to magnetic attraction and adapted for connection into an external electric circuit is mounted in the proximity of the monitoring flow passage at a region such that it is operated by magnetic interaction with the plunger when the plunger is urged a predetermined distance from the inlet. A preferred method of mounting the reed switch called for in the preferred embodiment of the invention described above, would be to drill a bore in the proximity of and generally parallel to the monitoring flow passage at a region such that the reed switch may be operated by magnetic interaction with the plunger when the plunger is urged a predetermined distance from the inlet.

g. Finally, in the monitoring of certain highly reactive fluid flows, the preferred method of fabricating a flow actuated indicator would add to the steps outlined above a step calling for the coating of said magnetic plunger, first and second rod members and the interior wall, of said straight monitoring flow passage with a material refractory to the fluid being monitored.

Although I have herein set forth and described my invention with respect to certain specific principles and details thereof, it will be obvious to those skilled in the art that these may be varied without departing from the spirit and scope of the invention as set forth in the hereunto appended claims. Consequently, all modifications and changes that will become apparent to those of ordinary skill in the art are intended to be covered by the appended claims.

I claim:

1. A fluid flow indicator comprising the combination of: a constant area body member defining a monitoring flow passageway having an inlet and an outlet, annular retaining channels at each of said inlet and outlet, first and second rod members removably positioned within said monitoring flow passageway in each of said annular retaining channels at each of said inlet and outlet, each of said first and second rod members being of inert, synthetic material and being sufficiently flexible to allow bending thereof for insertion of its termini into each of opposed portions of said annular retaining channels; and a magnetic plunger member captively disposed within said monitoring flow passageway intermediate said first and second rod members and being responsive to fluid flow by movement thereof and operatively associated switch means responsive to the position of said magnetic plunger member to energize or de-energize an electric circuit.

2. The flow actuated indicator in accordance with claim 1 wherein said monitoring flow passage is vertically positioned.

3. The flow actuated indicator in accordance with claim 1 wherein said body member defining a monitoring flow passageway is composed of a nonmagnetic material.

4. The flow actuated indicator in accordance with claim 1 wherein said switch means is a reed switch having contact points which close in response to the plunger when it is urged to a predetermined longitudinal distance within the monitoring flow passage.

5. The flow actuated indicator in accordance with claim 1 wherein said switch means is mounted in a bore in said body member defining a straight, monitoring flow passage therethrough with an inlet at one end and an outlet at another end parallel said monitoring flow passageway.

6. The flow actuated indicator in accordance with claim 4 wherein said reed switch is hermetically sealed.

7. The flow actuated indicator in accordance with claim 1 wherein said magnetic plunger is coated with a material refractory to the fluid being monitored.

8. The flow actuated indicator comprising:

a body defining a constant area, monitoring flow passage therethrough with an inlet at one end and an outlet at another end;

a magnetic plunger loosely contained by said constant area monitoring flow passage such that when the monitor is oriented with said inlet below said outlet and fluid flows from said inlet to said outlet through said monitoring flow passage, resistance to longitudinal movement of the plunger through the monitoring flow passage by said fluid is provided solely by the weight of said plunger, whereby in the absence of fluid flow through said monitoring flow passage said plunger rests near the inlet under the influence of gravity but when fluid flows through said monitoring flow passage the plunger is carried by the fluid for a distance depending on the velocity of the fluid longitudinally in said monitoring flow passage away from said inlet;

a reed switch operatively responsive to magnetic attraction adapted for connection into an external electric circuit, mounted in the proximity of the monitoring flow passage at a region such that it is operated by magnetic interaction with the plunger when the plunger is urged a predetermined distance from the inlet;

a first and a second annular channel normal to the fluid flow and positioned adjacent to the inlet and the outlet of the monitoring flow passage; and, a first and a second rod member, the termini of which are operatively retained and received within said first and second annular channels respectively to restrict the plunger to longitudinal movement within the monitoring flow passage, said first and second rod members being of synthetic, inert material and being sufficiently flexible to allow bending thereof so that said termini may be retained in said first and second annular channels but sufficiently rigid to captively retain said magnetic plunger between said first and second rod members.

* * * * *